United States Patent [19]

Sheth

[11] 4,032,269

[45] June 28, 1977

[54] ROTARY VANE COMPRESSOR WITH VANE EXTENSION MEANS OF IMPROVED DESIGN

[75] Inventor: Rajesh N. Sheth, Mount Prospect, Ill.

[73] Assignee: Borg-Warner Corporation, Chicago, Ill.

[22] Filed: May 28, 1976

[21] Appl. No.: 691,060

[52] U.S. Cl. ..... 418/266; 267/152; 418/238

[51] Int. Cl.[2] ..... F04C 29/00; F16F 3/08

[58] Field of Search ..... 418/122, 123, 129, 248, 418/259, 266, 267, 238, 142; 267/152, 153

[56] References Cited

UNITED STATES PATENTS

| | | | |
|---|---|---|---|
| 3,191,503 | 6/1965 | Fuehrer | 418/266 |
| 3,277,833 | 10/1966 | Hudgens | 418/122 X |
| 3,990,819 | 11/1976 | Ritchie | 418/124 X |

*Primary Examiner*—Carlton R. Croyle
*Assistant Examiner*—Leonard Smith
*Attorney, Agent, or Firm*—Richard J. Schlott

[57] ABSTRACT

A rotary sliding vane compressor having means for biasing the vanes outwardly. Such means include a resilient element of improved design located in the lower portion of the vane slot and engaging a convexly shaped edge on the vane. The flexing action of the resilient member ensures that the vanes will be moved outwardly during the expansion phase of rotor travel.

3 Claims, 6 Drawing Figures fig.4.
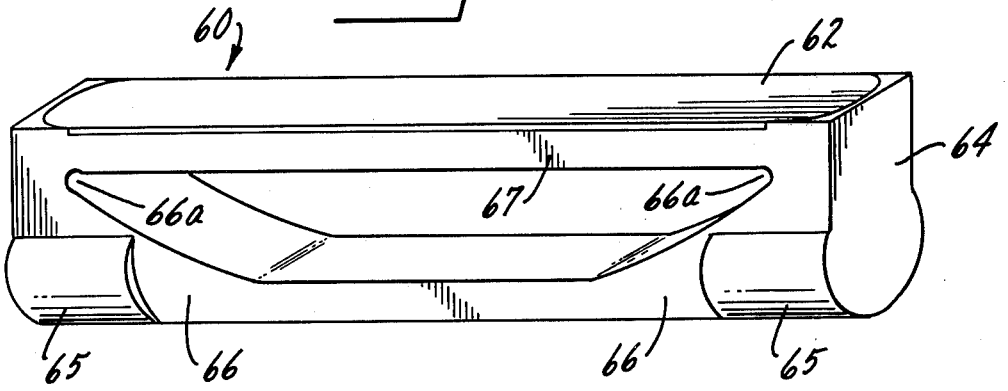
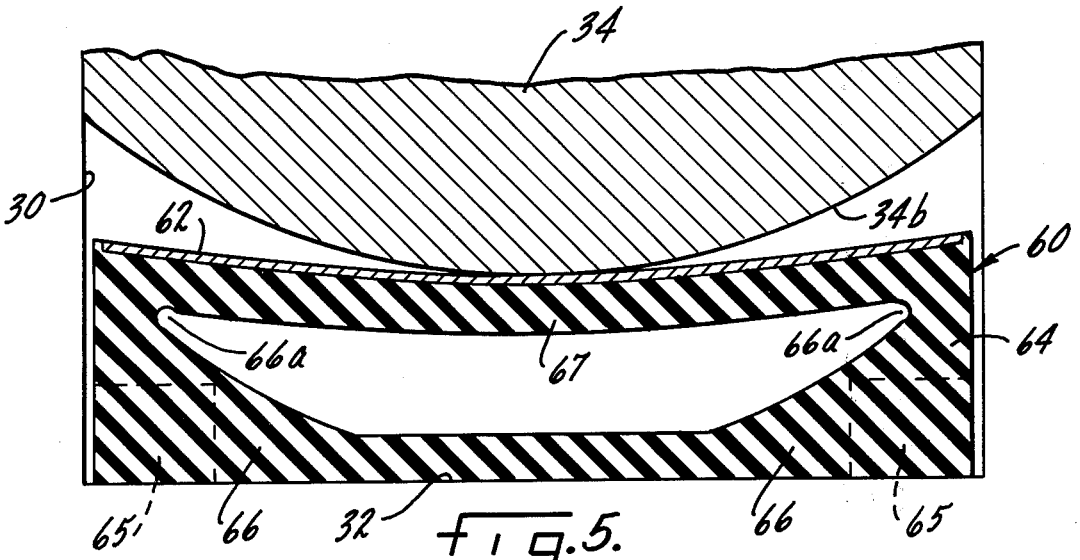
fig.5.
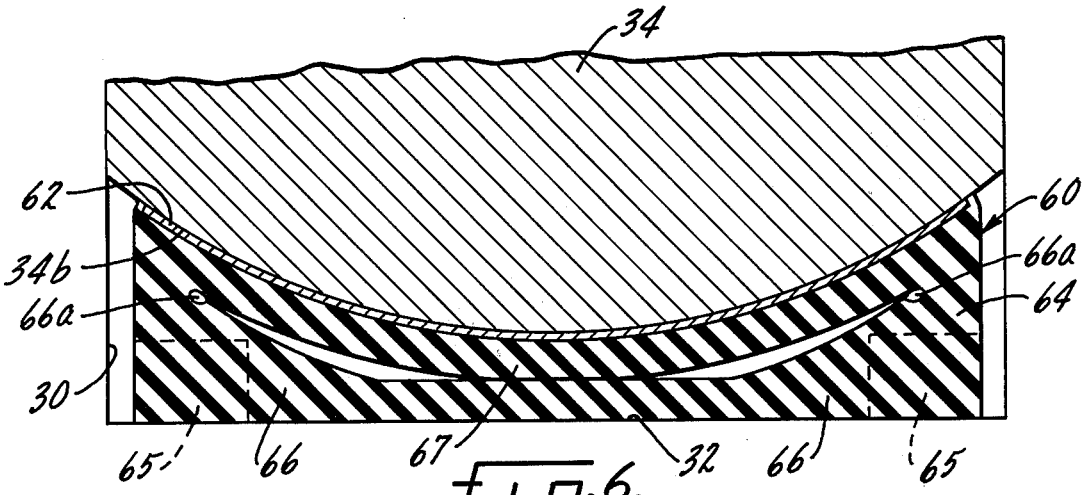
fig.6.

ROTARY VANE COMPRESSOR WITH VANE EXTENSION MEANS OF IMPROVED DESIGN

BACKGROUND OF THE INVENTION

1. Field of the Invention

A rotary sliding vane compressor having means for urging the vanes outwardly and maintaining the vane tips in engagement with the cylinder wall during start-up and at rotational low speeds.

2. Description of the Prior Art

Burnett U.S. Pat. No. 3,376,825 describes a rotary vane compressor having a leaf type spring element between the radially inner portion of the vane and the bottom of the vane slot. The spring is designed so that during high speed operation, when centrifugal forces are sufficient to maintain the vane tips in contact with the cylinder wall, the same centrifugal forces will cause the spring to collapse against radially inner edges of the vane and thus become ineffective as a spring element.

English U.S. Pat. No. 1,984,365 describes a rotary sliding vane compressor having a leaf type spring in the bottom of the vane slot and having its convex side in contact with the central region of the vane edge which is essentially linear.

Kenney et al. U.S. Pat. No. 2,045,014 also discloses a leaf spring with its ends embedded in the bottom of the vane.

Fuehrer U.S. Pat. No. 3,191,503 shows a sliding vane fluid handling apparatus which uses O-rings of elastomeric material underneath the vanes to bias the same outwardly.

Gibson et al. U.S. Pat. No. 1,857,276 is representative of a large number of prior art references which utilize fluid pressure underneath the vanes to maintain the vane tips in engagement with the cylinder wall.

SUMMARY OF THE INVENTION

This invention relates in general to rotary sliding vane compressors and more particularly to an effective means for biasing the vanes radially outwardly to maintain the vane tips in sliding engagement with the cylindrical wall of the rotor chamber which forms the gas working space. Although rotor sliding vane compressors are known in a great many forms, the description herein is directed to a conventional type in which a rotor is provided with a plurality of extensible vanes each received with a generally radially oriented or canted vane slot in the rotor. The rotor is received within a cylindrical chamber or stator and mounted such that its axis is offset with respect to the cylindrical stator axis, thus providing a generally crescent shaped gas working space. The rotor is in sliding contact with a portion of the cylindrical wall, and this contact point divides the low pressure side from the high pressure side. An inlet port communicates with one side of the gas working space and a discharge port communicates with the opposite side. Gas is trapped between adjacent vanes and carried around through the the compression zone. The volume of each pocket or compartment, as defined between adjacent vanes and the rotor and stator surfaces, becomes smaller as it approaches the discharge port thus compressing the gas trapped therein.

A problem is often encountered in operating compressors of the type described above in that the vanes sometimes will not maintain their tips in engagement with the cyclindrical stator wall under all conditions. This is especially true at start-up when the rotor is travelling at low rotational velocities. The centrifugal force which would normally tend to throw the vanes outwardly is not sufficient to overcome the vacuum created when the vanes begin to move from their most radially inward portion to the point directly opposite the contact point. The latter may be regarded as a dash-pot effect and is extremely powerful in resisting the outward thrust of the vanes.

Several techniques have been used in the prior art to hold the vane tips in engagement with the cylindrical wall. Basically, these may be divided into two categories: mechanical (such as spring) and hydraulic or pneumatic. The mechanical springs used may take many forms, such as the leaf springs described in Burnett, Kenney et al and English, or helical (coil) springs. Just as common are the hydraulic or pneumatic means such as described in Gibson et al.

In the present invention, a mechanical element is employed which overcomes many of the disadvantages of the springs heretofore known. It is difficult to obtain any significant service life when using a leaf or coil spring in the typical rotary compressor environment. With each revolution of the rotor the spring is compressed and released. Since the compressors operate at several hundred R.P.M., it is apparent that the springs undergo flexing at unusually high rates and thus are subject to fatigue failure.

The objective of the present invention is to minimize the amount of flexure involved, and especially to limit or eliminate completely the lateral travel of the spring ends and consequent abrasion of the spring. The present invention employs a novel composite spring having a metal portion in contact with the vane to provide the necessary rigidity and wear surface and a bonded rubber or elastomeric component to extend the life of the metal element.

Superior load distribution which is accomplished by mating the curved vane bottom with a rubber/metal composite spring assembly. The wear surface provided by the metal spring, in combination with the rubber or elastomeric element, is effective is dampening noise during operation. The rubber or elastomeric component is particularly designed to reduce to a minimum the proportion of rubber undergoing flexing and thus to increase the useful life of the composite spring.

The assembly is compact, inexpensive to install, and requires no special modifications to conventional compressor parts.

Other advantages to this system include the fact that since no hydraulic means are provided for maintaining the vanes extended, it is not necessary to provide either a lubricant pump or other means for collecting and distributing oil and/or refrigerant to the undervane spaces. It also provides instant pumping action upon start-up, reduces hammering and consequent vane wear caused by delayed movement of the vane to the extended position, eliminates reverse rotation at rotor shutdown often caused by equalization of pressures between the high and low sides of the compressor rotor, and results in lower discharge gas temperature.

BRIEF DESCRIPTION OF THE DRAWINGS

FIG. 4 is a perspective view of the resilient element;

FIG. 5 is a cross sectional view taken along the plane of 5—5 of FIG. 3; and

FIG. 6 is a view similar to FIG. 5 showing the resilient element in its fully flexed position.

DESCRIPTION OF THE PREFERRED EMBODIMENT

Figure 1:
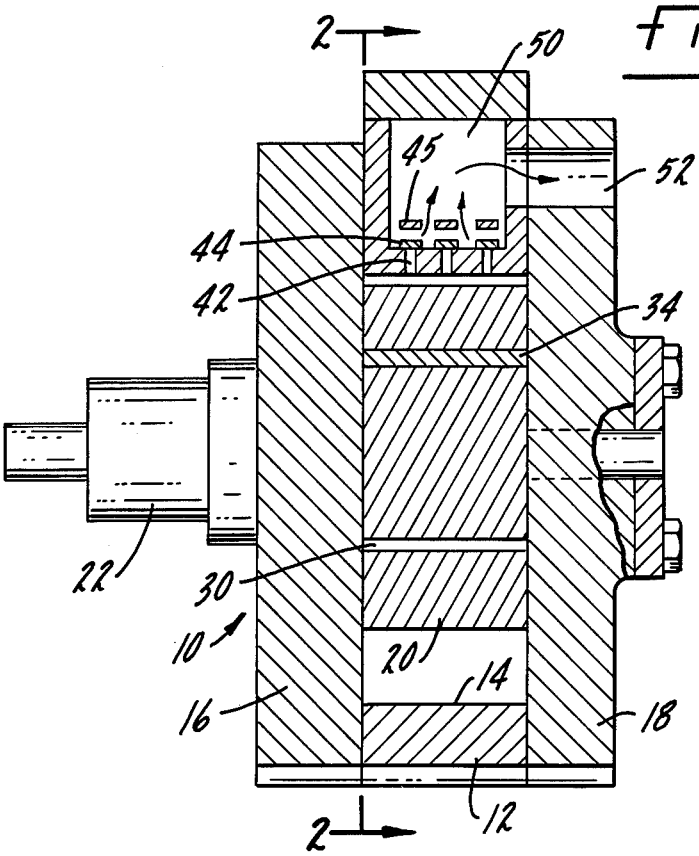
FIG. 1 is a cross sectional view of a rotary sliding vane compressor constructed in accordance with the principles of the present invention.
Figure 3:
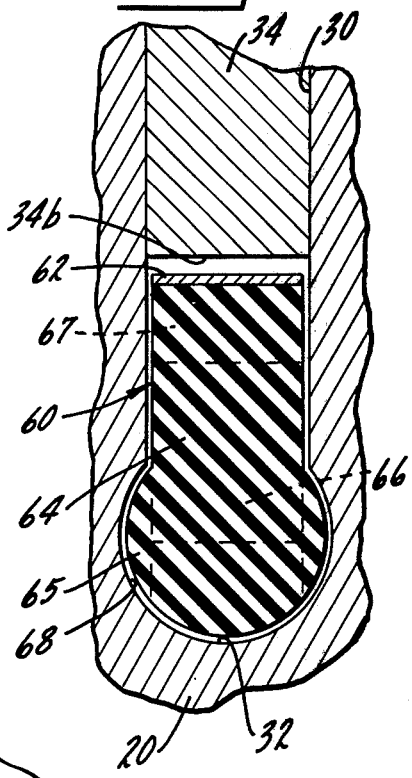
FIG. 3 is a greatly enlarged sectional view showing the relationship of the resilient element with respect to the vane and the vane slot.
Figure 2:
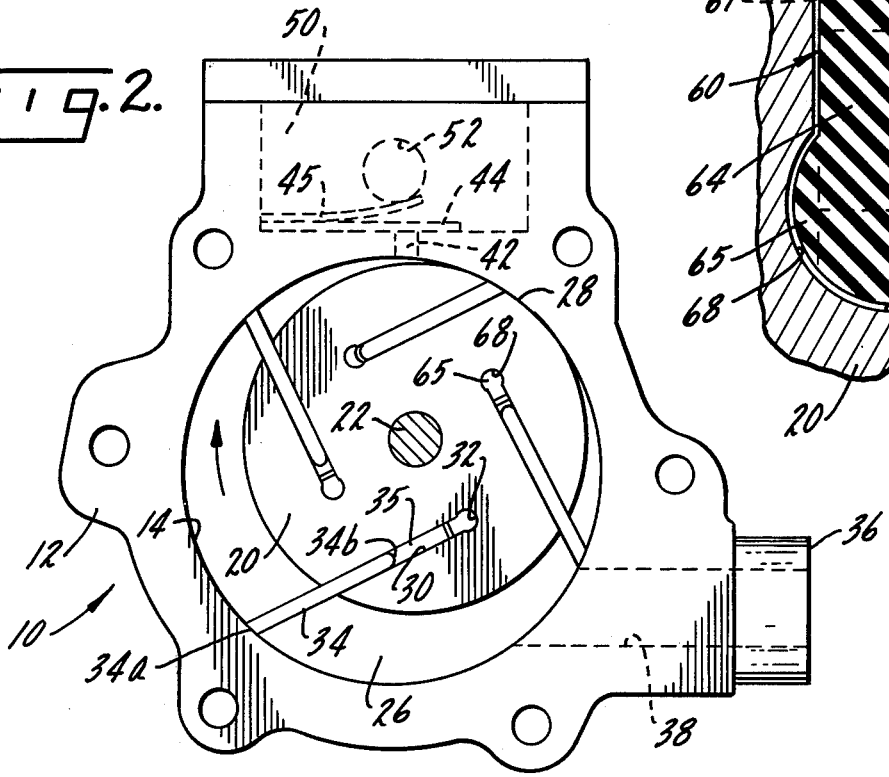
FIG. 2 is a cross sectional view taken along the plane of line 2—2 of FIG. 1.

Referring now the drawings, particularly to FIGS. 1 and 2, there is shown a typical rotary compressor of generally conventional design including a stator housing 10 comprising a cylinder block 12 having a circular bore extending therethrough to provide a cylinder wall 14, a front end plate 16, and a rear end plate 18. Within housing 10 there is provided a rotor 20 connected to and driven by drive shaft 22. The rotor is eccentrically mounted within the cylinder 14 so that it is in close running contact with the cylinder wall 14 at a contact point 28 and forms a crescent-shaped gas working space or compression cavity 26. The rotor is provided with a plurality of vane slots 30 each having a bottom surface 32 and receiving vanes 34 which are adapted to reciprocate within each vane slot with their upper edges 34*a* in continuous engagement with cylinder wall 14. It may be seen that the lower sides of each slot, the bottom edge 34*b* of the vanes 34, and the bottom of the vane slot 32 define what will be referred to as the "undervane space", designated 35.

Suction gas is admitted to the compression cavity 26 through connection 36 and passage 38. Gas is discharged through a series of openings 42 (adjacent the contact point) which are covered by reed-type discharge valves 44, limited by valve stops 45. Discharge gas flows into chamber 50 and then through passage 52 in rear plate 18.

Located between the lower edge of each vane and the bottom of the vane slot 32 is a resilient element 60, shown in partial perspective view in FIG. 4, which includes a first component in the form of a flat spring 62 formed of spring steel or other suitable alloy having good wear characteristics and adapted to withstand a large number of flexures at high frequency without failure. Bonded to the spring element is a one-piece molded elastomeric damper 64 having cylindrically-shaped terminal portions 65, connected through pier portions 66 adapted to support the outer ends of a spring support section 67 having a relatively thin cross-sectional area as compared to the terminal portions. The cylindrically-shaped ends 65 of damper 64 are adapted to seat in complementary sockets 68 formed in the ends of vane slot 30. This arrangement provides means for retaining the damper 64 within the vane slot in proper relation to the vane during assembly and while in operation.

As best shown in FIG. 5, the bottom edge 34*b* of each vane is curved thus forming a convexly shaped edge engageable with the flat spring component 62 of the resilient element 60. The pier sections 66 are joined through means defining a curve edge generally complementary in shape to the bottom edge 34*b* of the vane, and join the spring support section through relieved corner areas 66*a*. When the vanes are fully extended, as shown in FIG. 5, the resilient element 60 lies flat across the entire vane slot region. At this point the resilient element is completely unflexed; and no portion thereof is under either compression or tension.

As best shown in FIG. 6, the resilient element 60, after engagement with convexly shaped edge 34*b*, is in a condition where the spring support section 67 assumes the same general contour as the bottom edge 34*b*, and is forced downwardly and is received by the complementary-shaped pier portions. It is essential that the compression of the rubber component be avoided inasmuch as high frequency compressive forces would result in rapid deterioration of the elastomer. Hence the combined thickness of the spring support portion 67 and the pier portions 66 will not exceed the minimum vertical height that obtains at any point within the undervane space 35. Further, the corner areas 66*a* are fully relieved to prevent the development of compressive stresses in the rubber when the spring is in this fully engaged position. At this point, the spring is in a condition to bias the vane upwardly against the inside cylinder wall or stator, and this will result in immediate pumping action upon start-up prior to the generation of enough centrifugal force to hold the vanes in contact with the cylinder wall.

While a variety of elastomeric compounds may be used in making element 64, they should be resistant to the oil-refrigerant environment in which they must operate in a refrigeration/air conditioning application. Suitable materials would include urethane, nitrile, epichlorohydrin, fluorocarbon and silicone rubbers. The element 64 may be formed by any of a variety of compression molding processes common to the rubber processing art, and the metal spring element may be bonded to the element 64 during the molding process or in a subsequent operation. Any of a number of adhesives suitable for the bonding are widely available, and one such material is TyPly-BN, available from Hughson Chemical Corp.

While this invention has been described in connection with certain specific embodiments thereof, it is to be understood that this is by way of illustration and not by way of limitation; and the scope of the appended claims should be construed as broadly as the prior art will permit.

I claim:

1. In a rotary compressor including a cylindrical rotor having a plurality of extensible vanes received in complementary vane slots, the improvement comprising: means defining a convex edge on the radially inner portion of said vanes, and a resilient element engageable with said convex edge, said resilient element having an intermediate section normally spaced from the bottom of said vane slots and adapted to flex downwardly upon engagment by said vane, said intermediate section supported by pier sections joined through means defining a concave edge adapted to receive said intermediate section when downwardly flexed.

2. In a rotary compressor including a cylindrical rotor having a plurality of extensible vanes received in complementary vane slots, the improvement comprising: means defining a convex edge on the radially inner portion of said vanes, and a resilient element engageable with said convex edge, said resilient element having an intermediate section normally spaced from the bottom of said vane slots and adapted to flex downwardly upon engagement by said vane, said intermediate section supported by pier sections joined through means defining a concave edge adapted to receive said intermediate section when downwardly flexed, said resilient elements having cylindrically shaped terminal portions received in complementary sockets formed at the end of each of said vane slots.

3. Apparatus as defined in claim 2 wherein said resilient element comprises a metal spring member and an elastomeric member bonded thereto, said spring member providing a wear surface engageable by said vane edge.

* * * * *